United States Patent [19]

Cole

[11] Patent Number: 4,911,674

[45] Date of Patent: Mar. 27, 1990

[54] SELF SEALING VALVE FOR INFLATING TOY BALLOONS

[75] Inventor: Eugene F. Cole, Ashland, Ohio

[73] Assignee: Specialty Advertising, Inc., Ashland, Ohio

[21] Appl. No.: 766,525

[22] Filed: Aug. 19, 1985

[51] Int. Cl.[4] ..... A63H 27/10

[52] U.S. Cl. ..... 446/224; 137/853

[58] Field of Search ..... 446/222, 224, 220; 137/231, 223, 853

[56] References Cited

U.S. PATENT DOCUMENTS

| | | | |
|---|---|---|---|
| 563,287 | 7/1896 | Lane et al. . | |
| 1,326,445 | 12/1919 | Fewlass . | |
| 1,800,066 | 4/1931 | Glass | 137/853 X |
| 2,734,308 | 2/1956 | Gassaway . | |
| 2,792,669 | 5/1957 | Jackson et al. . | |
| 3,063,462 | 11/1962 | Potash . | |
| 3,220,729 | 11/1965 | Whittington . | |
| 3,410,299 | 11/1968 | Whittington . | |
| 4,034,501 | 7/1977 | Zeyra . | |
| 4,167,204 | 9/1979 | Zeyra | 446/220 X |

FOREIGN PATENT DOCUMENTS

| | | | |
|---|---|---|---|
| 16297 | 9/1891 | United Kingdom | 446/222 |
| 1020784 | 2/1966 | United Kingdom . | |

*Primary Examiner*—Mickey Yu

*Attorney, Agent, or Firm*—Baldwin, Egan & Fetzer

[57] ABSTRACT

A mass produced, self sealing valve for inflating toy balloons and adapted to be retained with the balloon to maintain the inflation thereof. The valve has an elongated tubular shank closed at one end and open at the other, with a sealing disc secured to the shank and extending therefrom in a generally orthogonal plane. The shank is perforated intermediate the disc and the closed end of the shank. An elastic sleeve encompassing the shank and overlying the perforation permits pressurized gas to pass via the shank thrugh the perforation and past the sleeve, but prevents the escape of pressurized gas from the interior of the associated balloon. The sleeve is provided with exterior lengthwise ribs to prevent squealing of the valve under pressure. The open end of the valve shank is provided with a flared configuration and an elongated depending tongue, for facilitating the positioning of the valve on a gas discharge nozzle of a pressurized source of gas, such as, for instance, a tank of helium, for effecting inflation of the associated balloon.

9 Claims, 1 Drawing Sheet

SELF SEALING VALVE FOR INFLATING TOY BALLOONS

This invention relates to a mass produced, self sealing valve for inflating toy balloons and adapted to be retained with the balloon, for maintaining the inflation thereof, and more particularly to self sealing valve which includes an elongated tubular shank closed at one end and open t the other, and having a sealing disc extending therefrom in a generally orthogonal plane, with valving means on the shank for permitting pressurized gas to pass via the shank into the balloon, but preventing the escape of pressurized gas from the interior of the balloon, together with means on the open end of the shank for facilitating the positioning of the valve on a gas discharge nozzle of a pressurized source of gas, such as, for instance, a tank of helium, for effecting inflation of the associated balloon.

BACKGROUND OF THE INVENTION

Toy balloons are conventionally inflated by means of compressed gases, such as, for instance, helium gas, or a combination of helium gas and air, after which the neck of the balloon is tied either by knotting the material of the balloon itself, or by passing a string around the neck and pulling it tight, such string providing not only for sealing the neck against the escape of pressurized gas, but also providing a means for holding onto the balloon.

Also, it is known in the art to provide a valve inflation device for sealing the pressurized gas interiorly of the balloon for permitting the pressurized gas to pass into the interior of the balloon and inflate the balloon, while preventing the exiting of pressurized gas from the interior of the inflated balloon. One such inflation device is illustrated in U.S. Pat. No. 4,034,501 dated July 12, 1977 issued to Abraham Zeyra and entitled Unitary Inflation Devices for Helium Balloons and Their Like.

Pat. No. 1,326,445 dated Dec. 30, 1919, to Fewlass, and entitled Pneumatic or Air Valve for Inflating Various Bodies, discloses an air valve which is adapted to be cemented or vulcanized or otherwise connected to an inflatable article, with the air valve including an elastic band or sleeve for sealing an aperture in the body of the valve, to prevent the escape of air from an inflated article.

Pat. No. 2,792,669 dated May 21, 1957 to Jackson et al, and entitled Balloon, discloses an air valve having a telescopically movable apertured stem disposed in a plug body member, and when helium is applied to the stem, the latter is forced inwardly to allow helium to move through the bore in the stem, and associated transverse apertures, into the balloon body. Upon reduction of pressure exerted exteriorly of the valve, the stem is forced outwardly by the pressure on its enlarged head and the valve face seats in fluid tight relation on a seat.

Pat. No. 3,220,729 dated Nov. 30, 1965 to Whittington, and Pat. No. 3,410,299 dated Nov. 12, 1968 to Whittington, disclose air valves utilizing elastic bands or sleeves, for sealing an apertured inflating stem.

Pat. No. 563,287 issued July 7, 1986 to Lane et al and entitled Toy Balloon; Pat. No. 2,734,308 issued Feb. 14, 1956 to Gassaway and entitled Reentrant Inflation Tube and Control Valve for Inflatable Articles; Pat. No. 3,063,462 dated Nov. 13, 1962 to Potash and entitled Resilient Valve; and British Pat. No. 1,020,784 dated 1966 and entitled Improvements in or Relating to the Sealing of Inflated Balloons, disclose other arrangements of air valves for inflating and sealing inflatable articles.

None of such prior art arrangements disclose applicant's novel self sealing valve which includes means for expeditiously positioning the valve on a gas discharge nozzle of a pressurized source of gas for effecting inflation of the associated balloon, and which once inflation is accomplished, remains with the balloon and is effective to prevent the escape of pressurized gas from interiorly of the balloon.

SUMMARY OF THE INVENTION

The present invention provides a novel, mass produced, self sealing valve for inflating toy balloons and adapted to be retained with the balloon for maintaining the inflation thereof, and wherein the valve includes an elongated tubular shank closed at one end and open at the other, with a sealing disc attached to the shank and extending therefrom in a general orthogonal plane, for sealing the neck of the associated balloon from the escape of pressurized gas, and including valving means on he closed end of the shank for permitting pressurized gas to pass via the shank into the balloon but preventing the escape of pressurized gas from the interior of the balloon, and wherein the open end of the valve shank includes means for facilitating the positioning of the valve on a gas discharge nozzle of a pressurized source of gas, for effecting inflation of the balloon.

Accordingly, an object of the invention is to provide a novel, mass produced, self sealing valve for effecting inflation of a toy balloon, and adapted to be retained with the balloon for maintaining the inflation thereof.

Another object of the invention is to provide a valve of the latter mentioned type which includes an elongated tubular shank closed at one end and open at the other, and which includes a sealing disc attached to the shank and extending therefrom in a generally orthogonal plane, adapted for sealing engagement with the neck of the balloon, and wherein the open end of the valve shank which is adapted for directing the flow of pressurized gas into the interior of the balloon, has means thereon for facilitating the positioning of the valve on a gas discharge nozzle of a pressurized source of gas.

A still further object of the invention is to provide a valve of the latter described type wherein the means for facilitating the positioning of the valve on a gas discharge nozzle comprises a flare on the open end of the shank.

A still further object of the invention is to provide a mass produced, self sealing valve of the aforementioned type wherein the valving means includes a perforation in the shank intermediate the disc and the closed end of the shank, with an elastic sleeve encompassing the shank and overlying the perforation, thus providing for pressurized gas to pass via the shank through the perforation and past the sleeve, but preventing the escape of pressurized gas from the interior of the balloon, and wherein the exterior of the sleeve is ribbed.

A still further object of the invention is to provide a self sealing valve of the aforementioned type in conjunction with a balloon, for maintaining the inflation thereof, and with the valve including a shank which projects outwardly of the neck of the balloon and is adapted for gripping by the user, thus obviating the necessity of having a string or other attaching means on the balloon.

Other objects and advantages of the invention will be apparent from the following description taken in conjunction with the accompanying drawings wherein:

DESCRIPTION OF PREFERRED EMBODIMENT

Figure 1:
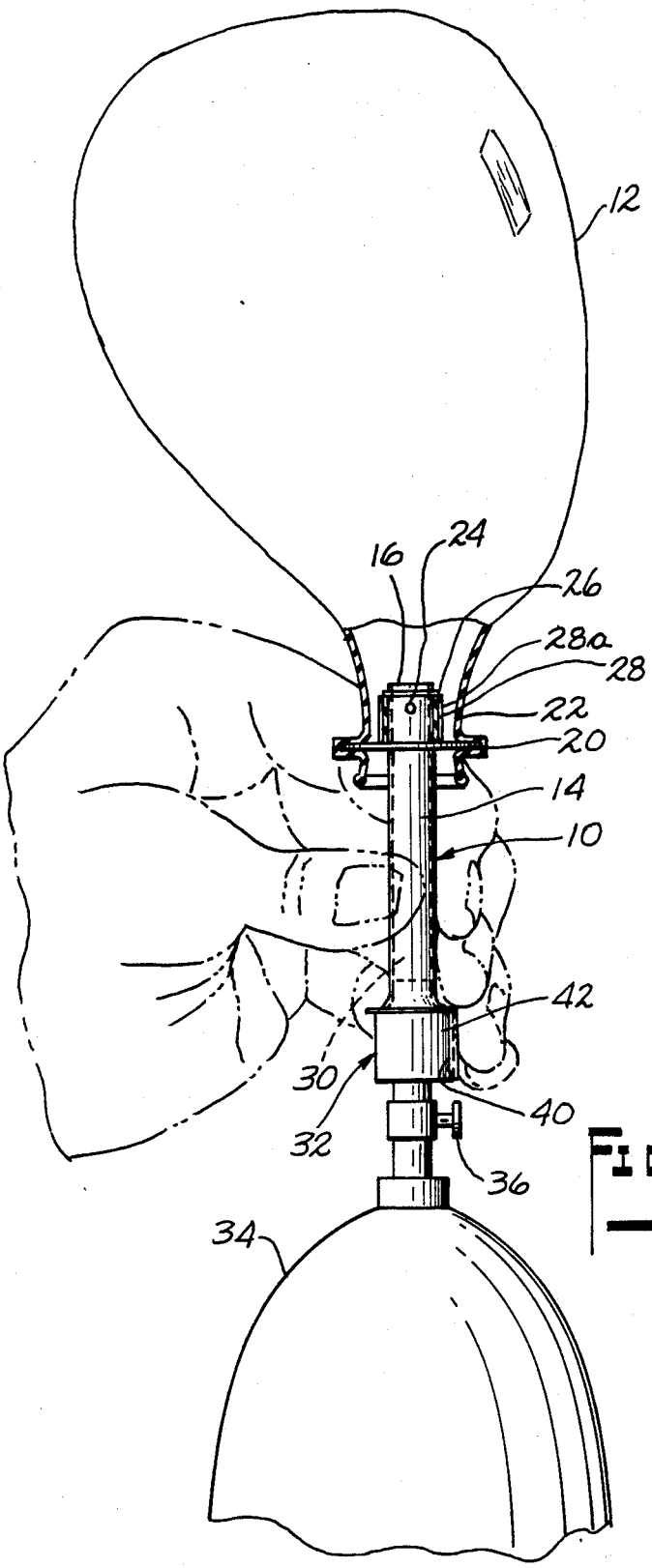
FIG. 1 is a fragmentary, partially sectioned, elevational view of a self sealing valve embodying the invention attached to a toy balloon, and positioned on a gas discharge nozzle of a source of pressurized gas such as helium, for effecting inflation of the balloon.

Referring now again to the drawings and particularly to FIG. 1, there is shown a mass produced valve embodying the invention and assembled with a balloon 12. The valve 10 comprises an elongated tubular shank 14 closed at one end (e.g. 16) and open at the other end (e.g. 18). A sealing disc 20 is secured to the shank and extends therefrom in a generally orthogonal plane.

As can be seen in FIG. 1, the disc 20 is adapted to engage with he interior of the neck 22 of the balloon and to stretch it out, and provides a barrier for preventing the escape of pressurized gas from interiorly of the balloon past the disc.

The shank is perforated as at 24, intermediate disc 20 and the closed end 16 of the shank. In the embodiment illustrated, a shoulder 26 is formed adjacent the closed end 16 of the shank. An elastic sleeve 28 formed, for instance, of rubber, encompasses the shank in generally snug relation and overlies the perforation 24. Sleeve 28 in the embodiment illustrated extends completely between the shoulder 26 and the disc 20, and thus is prevented from or limited in axial movement relative to the shank. The sleeve 28 is expandable by pressurized gas, and thus permits the pressurized gas to pass through the passageway 30 in the shank and through the perforation 24, and thence past the sleeve and into the interior of the balloon. Such resilient sleeve upon termination of the application of pressurized gas to the valve covers the perforation 24 and prevents the escape of pressurized gas from the interior of the balloon through the perforation.

Figures 4, 5:
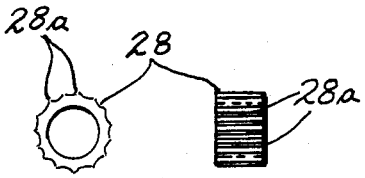
FIG. 4 is an end elevational view of the resilient or elastic sleeve member which covers the perforation in the shank of the valve, for permitting pressurized gas to pass via the shank through the perforation and past the sleeve, but which prevents the escape of pressurized gas from the interior of the associated balloon back through the perforation.
FIG. 5 is a side elevational view of the sleeve member illustrated in FIG. 4.
Figure 2:
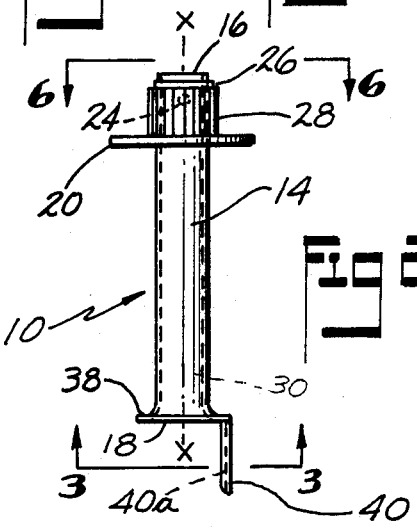
FIG. 2 is an elevational view of the valve illustrated in FIG. 1.

The sleeve 28 is preferably ribbed lengthwise thereof as at 28*a*, and as illustrated, for instance, in FIG. 5, which not only strengthens the sleeve, and aids in the stabilization of the sleeve in its function of preventing gas from flowing back through aperture 24 from interiorly of the pressurized balloon, but also such ribbed exterior aids in preventing a "squealing" noise as the pressurized gas enters the balloon via shank 14. Such "squealing" noise which is generally high pitched is disagreeable to the ears, and as aforementioned is prevented or materially alleviated by ribs 28*a*.

In accordance with the invention, the open end 18 of the valve shank is provided with means for facilitating the positioning of the valve on a gas discharge nozzle 32 of a pressurized source of gas, such as, for instance, a tank 34 of helium. Tank 34 may be provided with a hand controlled valve 36 of conventional type for manually closing off the exiting of the pressurized gas from the tank and through the gas discharge nozzle 32.

The aforementioned means at the end 18 of the valve shank comprises a flare 38 on the open end of the shank 14, and adapted to fit generally snugly onto the complementary configured end of the gas discharge nozzle 32, and as illustrated in FIG. 1.

Figure 3:
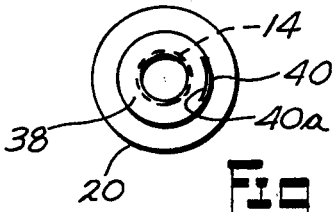
FIG. 3 is a sectional view taken generally along the plane of line 3—3 of FIG. 2 looking n the direction of the arrows.
Figure 6:
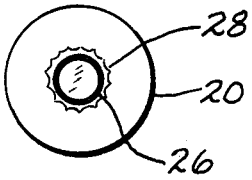
FIG. 6 is a top plan view of the valve taken generally along the plane of line 6—6 of FIG. 2, looking in the direction of the arrows.

Also there is preferably provided a tongue 40 depending from the flared end of the valve shank, and adapted to be received in generally adjacent oriented relationship to the side surface 42 of the gas discharge nozzle as illustrated in FIG. 1, and to be gripped by a finger of an operator, to hold the valve and position it firmly against the gas discharge nozzle during inflation of the balloon. Tongue 40 preferably has a concave inner face 40*a* (FIG. 3) for surface-to-surface engagement with the cylindrical exterior surface 42 of the gas discharge nozzle 32.

Operation is preferably as follows: the operator turns the mechanical valve 36 to open the same and permit the flow of gas from the pressurized tank 34 while he positions one of the balloon valves 10 and attached balloon on the gas discharge nozzle 32. Gas passes through the passageway 30 up to the closed end of the valve 10 and forces the sleeve 28 outwardly to permit the pressurized gas to enter into the interior of the balloon via perforation 24 and past the elastic sleeve.

The gas passing into the balloon via valve 10 is prevented from passing out the neck of the balloon because of the disc barrier 20, and upon termination of the application of pressurized gas to the valve 10, the sleeve 28 once more contracts to close off the perforation 24 and prevents the escape of pressurized gas from interiorly of the balloon via perforation 24.

The aforementioned flared end provides for the ready positioning of the valve 10 and associated balloon 12 onto the discharge valve 32, while the tongue gives a positive means for the operator to hold the valve tightly on the gas discharge nozzle 32 so that the gas being emitted from the pressurized tank 34 will pass through passageway 30 of the valve an into the interior of the balloon.

Once the balloon is inflated, the valve 10 remains with the balloon preventing the escape of gas from its interior and providing a means for gripping the inflated balloon and holding onto t. In this connection, the shank 14 of the valve preferably extends downwardly from the disc 20 a distance approximately six times the distance between the disc and the aforementioned shoulder 26 on the closed end of the shank.

The valve can be mass produced by known plastic molding techniques with the valve being formed of any suitable plastic material such as, for instance, polyethylene, resulting in an economical valve arrangement for inflating toy balloons while being retained therewith.

From the foregoing description and accompanying drawings, it will be seen that the invention provides a mass produced, self sealing valve for inflating toy balloons, and which is adapted to be retained with the balloon for maintaining the inflation thereof while providing a means for holding onto or gripping the inflated balloon. The valve comprises an elongated tubular shank closed at one end and open at the other, with a sealing disc secured to the shank intermediate its ends and extending therefrom in a generally orthogonal plane, with the shank being perforated intermediate the disc and the closed end of the shank and having an elastic sleeve encompassing the shank and overlying the perforation, for permitting pressurized gas to pass via the shank through the perforation and past the sleeve, but preventing the escape of pressurized gas from the interior of the associated balloon, and with the open end of the valve shank being provided with means for facilitating its positioning on a gas discharge nozzle of a pressurized source of gas, for effecting expeditious inflation of the associated balloon.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. In combination, a self sealing valve for retaining a balloon in inflated condition and a balloon including a neck, and a tank of pressurized inflating gas having a discharge nozzle on which said valve is positioned preparatory for inflating said balloon, said valve comprising an elongated tubular shank closed at one end and open at the other end, and having a sealing disc secured to said shank and extending therefrom in a generally orthogonal plane and into sealing stretching relationship with the interior of said neck of the balloon, with said closed end of said shank disposed interiorly of said balloon, said shank being perforated intermediate said disc and said closed end, and an elastic sleeve encompassing said shank and overlying said perforation for preventing the escape of pressurized gas from the interior of said balloon via said perforation, said sleeve being adapted to be stretched outwardly by pressurized gas applied thereto from said tank via said shank and said perforation to permit the entry of pressurized gas to flow from said discharge nozzle into said shank and thence into the interior of the balloon, said sleeve on its exterior being ribbed lengthwise thereof in the lengthwise direction of said shank with the interior surface of said sleeve being generally smooth, and means on said open end of said shank for facilitating the positioning of said valve on said discharge nozzle, the last mentioned means comprising a flare on said open end of said shank adapted to seat generally snugly on a complementary surface of said discharge nozzle and an elongated tongue extending from said flare adjacent the exterior periphery thereof and running along side a generally vertically oriented exterior surface of said discharge nozzle, said tongue being gripped by a finger of an operator's hand holding the valve on said tank for effecting inflation of said balloon.

2. The combination in accordance with claim 1 wherein said tongue is of concave configuration in transverse section on the surface thereof facing the lengthwise axis of said shank.

3. The combination in accordance with claim 2 wherein said shank is of circular configuration in transverse section.

4. The combination in accordance with claim 1 wherein said shank extends axially from said disc a distance approximately six times the axial distance between said disc and said closed end of said shank.

5. A self sealing valve for insertion into the neck of a balloon for use in inflating the balloon comprising, an elongated tubular shank closed at one end and open at the other, a sealing disc secured to said shank intermediate its ends and extending therefrom in a generally orthogonal plane, said disc being adapted for sealing relation with the interior of the neck of an associated balloon when said closed end is disposed interiorly of the balloon, said shank being perforated between said closed end and said disc, an elastic sleeve encompassing said shank and overlying said perforation to permit pressurized gas to pass through said shank and past said sleeve, but preventing the escape of pressurized gas through said perforation from the interior of an associated inflated balloon, and means on said open end of said shank for facilitating the positioning of said valve on a gas discharge nozzle of a pressurized source of gas, for effecting inflation of an associated balloon, the last mentioned means comprising a flare on said open end of said shank and an elongated tongue extending from said flare adjacent the exterior periphery thereof, said tongue extending generally parallel to the lengthwise axis of said shank and being adapted for gripping by a finger of an operator's hand for holding the valve on a tank of pressurized inflating gas, and wherein said sleeve is ribbed on the exterior extending lengthwise thereof with the interior surface of said sleeve being generally smooth.

6. A valve in accordance with claim 1 including shoulder means on said shank projecting laterally therefrom, said shoulder means being spaced from said disc in the direction of said closed end of said shank and projecting laterally of said shank a lesser amount as compared to the lateral projection of said disc relative to said shank, said sleeve being disposed intermediate said shoulder means and said disc in covering relationship to said perforation, said shoulder means and said disc being adapted to limit axial movement of said sleeve relative to said shank so as to locate said sleeve in generally covering relation to said perforation.

7. A valve in accordance with claim 5 formed of low density polyethylene plastic.

8. A valve in accordance with claim 5 wherein said tongue in horizontal cross section is of generally arcuate configuration on the interior side thereof.

9. A valve in accordance with claim 6 wherein said shoulder means is disposed generally adjacent the closed end of said shank, with said shank extending a substantial axial distance from said disc, and a distance substantially greater than the axial distance between said shoulder means and said disc, said extension of said shank being adapted for gripping by an individual holding onto an associated inflated balloon.

* * * * *